US008585431B2

(12) United States Patent
Dreier et al.

(10) Patent No.: US 8,585,431 B2
(45) Date of Patent: Nov. 19, 2013

(54) ELECTRICAL CONNECTION CLAMP

(75) Inventors: Andreas Dreier, Nunningen (CH); Andrea Mastrovito, Münchenstein (CH)

(73) Assignee: Woertz AG, Muttenz 1 (CH)

( * ) Notice: Subject to any disclaimer, the term of this patent is extended or adjusted under 35 U.S.C. 154(b) by 34 days.

(21) Appl. No.: 13/267,234

(22) Filed: Oct. 6, 2011

(65) Prior Publication Data

US 2012/0088394 A1 Apr. 12, 2012

(30) Foreign Application Priority Data

Oct. 9, 2010 (DE) ..... 20 2010 014 149 U

(51) Int. Cl.
*H01R 4/24* (2006.01)

(52) U.S. Cl.
USPC ..... 439/411; 439/835

(58) Field of Classification Search
USPC ..... 439/410, 411, 828, 829, 834, 835
See application file for complete search history.

(56) References Cited

U.S. PATENT DOCUMENTS 2,988,726 A 6/1961 Agron et al.
4,149,766 A * 4/1979 Stenz et al. ..... 439/441
4,212,509 A * 7/1980 Brooks et al. ..... 439/396
6,146,186 A * 11/2000 Barrat et al. ..... 439/410
6,250,950 B1 * 6/2001 Pallai ..... 439/441
7,115,001 B1 * 10/2006 Brockman et al. ..... 439/828
7,329,143 B2 * 2/2008 Schrader ..... 439/441
7,762,834 B2 * 7/2010 Schrader ..... 439/441
7,833,047 B2 * 11/2010 Pizzi ..... 439/441

FOREIGN PATENT DOCUMENTS

DE 20 2004 007 077 6/2005

OTHER PUBLICATIONS

Abstract for DE202004007077.
European Search Report dated Jan. 9, 2012 for Application No. EP 11 00 8077.

* cited by examiner

*Primary Examiner* — Thanh Tam Le
(74) *Attorney, Agent, or Firm* — Frost Brown Todd LLC

(57) ABSTRACT

A connection clamp for electrically connecting at least two electrical conductors includes at least one power carrying element, at least one substantially W-shaped spring and at least one spring receiver. The power carrying element includes at least two side walls, each respectively including at least one electrical contact surface at their insides oriented towards one another. The spring is arranged between the side walls. The arms of the spring are respectively arranged at a slant angle relative to the respectively adjacent side wall. The spring ends are configured as pull safety edges. An electrical conductor is insertable between a spring end and a side wall and the conductor is pressed against the contact surface through the spring force.

15 Claims, 3 Drawing Sheets

ELECTRICAL CONNECTION CLAMP

FIELD OF THE INVENTION

The invention relates to an electrical spring clamp for contacting at least two electrical conductors. The spring clamp includes at least one spring and a power conducting element with two side walls so that an electrical conductor to be contacted is insertable into the spring clamp between one respective spring end and a side wall.

BACKGROUND OF THE INVENTION

Electrical spring clamps in which an electrical conductor is clamped through a spring are known in the art.

For example U.S. Pat. No. 2,988,726 illustrates a spring that is enveloped by a can and supported by an adjustable bolt. The electrical conductors that are to be contacted are inserted between a bent section of the spring and the outer wall of the can and clamped through the spring pressure thus reinforced.

SUMMARY OF THE INVENTION

According to the invention a connection clamp is provided for electrically connecting at least two electrical conductors, the connection clamp including at least one power conducting element, a substantially W-shaped spring and a spring receiver. The power conducting element includes at least two side walls which respectively include at least one electrical contact surface on their insides oriented towards one another. The outer arms of the spring are respectively connected through a shoulder with a loop of the spring that is arranged between the arms. Thus the spring receiver includes three supports, wherein one support engages the loop and one respective support engages one respective shoulder of the spring. Furthermore the spring is arranged between the side walls. The arms of the spring are arranged respectively at a slant angle relative to the adjacent side wall. Furthermore the spring ends are configured as pull safety edges. Thus, the electrical conductor is insertable between a spring end and a side wall and is pressed against the contact surface through the spring force.

Additional features are inherent in the disclosed products and methods or will become apparent to those skilled in the art from the subsequent detailed description of embodiments and the accompanying drawing figures.

GENERAL DESCRIPTION OF OPTIONAL EMBODIMENTS

The connection clamp facilitates a rather simple assembly and safe support of electrical conductors to be contacted. Furthermore a simple and independent disengagement of contacted electrical conductors is provided.

Before a particular embodiment of the connection clamp is described in detail some general considerations regarding the optional embodiments are provided.

Spring clamps contrary to screw clamps typically provide rather simple insertion of the electrical conductors to be contacted and therefore provide a comfortable and quick assembly. In insertable spring clamps, this means spring clamps for inserting conductors without additional tooling, however, the clamping force due to the limited spring force of the springs for assembly without tools is typically limited. For good properties of the electrical contact between electrical conductors to be connected and the clamp, however, sufficient clamping pressure is required. For a higher spring force, however, depending on the properties of the conductor leads using a tool is typically required for opening the spring for inserting the conductor which, however, is typically still less complex than connecting a screw clamp. Loading springs through tools in turn requires space at the clamp. In this conflicting situation with various competing influencing factors (clamping pressure, simple and quick assembly, installation space) the present invention provides an improved solution.

The connection clamp described herein is a spring clamp for electrically contacting at least two electrical conductors. For this purpose it includes at least one power carrying element, an essentially W-shaped spring and a spring receiver.

The power carrying element includes at least two side walls which respectively include electrical contact surfaces at insides oriented towards one another. Thus, the power carrying element is not configured spring elastic and made from an electrically conductive material like e.g. copper and thus provides the electrical connection through the contact surfaces between the conductors to be connected. Also outside of the contact surfaces the power carrying element can be configured without electrical insulation. It is e.g. integrally made from metal in one piece.

The essentially W-shaped spring includes outer arms that are arranged on both sides, wherein the outer arms are respectively connected through a respective shoulder with a loop of the spring arranged between the arms. Thus, the spring is supported by the spring support through at least three supports in that one support engages the loop and one respective support engages a respective shoulder so that the spring extends like a serpentine about the supports. Thus, the outer arms facilitate essentially independently from one another to generate spring forces for clamping two electrical conductors respectively on both sides of the spring.

For clamping the electrical conductors the spring is arranged in a projection between the side walls. The arms of the spring are arranged respectively at a slant angle relative to the adjacent side wall. Thus, the spring ends are configured as pull safety edges. Through the edge clamped conductors are secured against a forced pull out or other unintentional loosening. The pull safety function is based on the principle of self locking in that the square edged spring ends dig into the surface of the clamped conductor at least slightly through the clamping pressure due to the spring force. Through slanting the arms, namely in that the angle between an inserted conductor and the arm is less than 90° a pull out of the conductor without pull relief of the spring without destroying or damaging the conductor is prevented. The self locking function can also be reinforced through a hook shaped configuration of the spring end. For disengaging the conductor the self locking can be removed through providing a pull relief for the spring through a tool.

Overall the connection clamp described herein is configured to clamp and electrically contact an electrical conductor in that it is inserted between a spring end and a side wall and pressed through the spring force against the contact surface.

Through the described connection surface at least two electrical conductors can be contacted through only one spring which can be configured e.g. integrally in one piece. In one configuration of the connection clamp the support of the spring receiver arranged in the loop of the spring extends substantially over an inner diameter of the loop so that the spring is supported with little clearance or at least in one direction from a spring end to an opposite end substantially without clearance.

In some embodiments the supports of the spring receiver are arranged in an apex portion of the shoulder or of the loop so that the spring with W-curvature is supported in the portion of the apexes of the curvature. Bending radii that are too small or a kinking of the spring can be prevented in that a support of the spring receiver includes at least a partial radius which essentially corresponds to the minimum desired curvature radius of the spring in the portion of the spring support.

In one embodiment the spring has a curvature radius of at least a tenth of the length of the arms in the apex portion of the shoulders and in the portion of the loop.

In some embodiments the W-shape of the spring can be implemented so that the supports in the portion of the shoulder are enveloped by approximately 50° to 60° or also by more than 90°. Thus alternatively also the support in the portion of the loop can be enveloped by the spring by approximately 170°-190°.

In some embodiments the spring ends contact the side walls in a condition where no conductor is inserted. Thus, the spring can have a particular preload in order to provide a minimum spring force.

In some embodiments of the connection clamp the spring force is not adjustable anymore after inserting and clamping the electrical conductors. Thus, the connection clamp does not include any adjustment devices e.g. for reinforcing the spring force of the springs after a conductor is inserted. Rather the spring force required for safely clamping the electrical conductors is provided solely through compressing the spring when inserting the conductor. This facilitates a quick assembly since an adjustment or readjustment of the clamping pressure is not required.

In one embodiment the spring of the connection clamp is arranged in the spring receiver so that the spring force is not adjustable. Accordingly the connection clamp does not include an adjustment element or another arrangement through which the spring force of the spring is changed through the production or preassembly of the connection clamp itself and also during the connection of electrical conductors during later use of the clamp. A variation of the spring force, however, can be provided through selecting different types of springs. The connection clamp is thus characterized through a simple configuration with few and relatively simple components.

In some embodiments the spring is configured symmetrical in longitudinal direction and arranged symmetrical to the contact surfaces of the power carrying element. As a consequence the two spring ends as a matter of principle have the same contact pressure and are thus suitable for connecting similar conductors, in particular conductors with identical cross sections. When the spring receivers shall be configured for connecting different conductors, in particular conductors with different cross sections, the different clamping pressure of both spring ends which is helpful for this application can be facilitated through an asymmetrical configuration of the spring and/or an asymmetrical arrangement of the spring with reference to the side walls.

In some embodiments the side walls, in particular the contact surfaces of the power carrying element are arranged substantially in parallel to one another. A totally parallel arrangement in the sense that the side walls are parallel to one another over their entire height and depth is thus not required. The side walls can be respectively bent outward e.g. in sections e.g. at their longitudinal ends so that they do not extend parallel to one another in these sections. The side walls or at least the contact surfaces of their power carrying element are respectively parallel to one another at least in partial portions. Thus, also two conductors to be contacted are insertable into the connection clamp essentially parallel to one another.

In some embodiments the side walls of the power carrying element include bulge. For example at least one contact surface can be arranged in the portion of the bulge. Also excessive opening of the spring can be prevented through the bulge forming a contact surface for the spring end.

In some embodiments of the connection clamp it is provided to load a spring with a tool, this means opening it for inserting or disengaging electrical conductors. For a tool e.g. a common screw driver or any other rod shaped tool is suitable. The connection clamp is e.g. configured so that the tool is insertable approximately from the direction of an insertable conductor e.g. parallel to the longitudinal direction of the conductor in order to form an intermediary space between the respective spring end and the side wall thus, e.g. the contact surface for inserting the conductor through pressing down an arm. Accordingly also the spring end with the pull safety edge can be lifted off from a previously inserted and clamped conductor in order to disengage it from the connection clamp without causing destruction. Thus, the tool only has to impact the spring itself but does not need to impact other components of the connection clamp. It can be provided that the spring is formed further for being loaded through the tool, e.g. through a notch where the tool can be engaged. Through the access of the longitudinal conductor orientation a space saving use of the connection clamp is feasible.

For the non destructive disengagement of the clamped conductor using the tool is typically necessary due to the pull safe self locking of the spring. Whether this also applies for inserting conductors depends from the spring force and the configuration of the respective conductor. In some embodiments of the connection conductor the spring force is sized so that the spring also has to be opened with the tool when the conductor is not yet inserted for inserting the conductor. The large spring force provides an even better and safer electrical connection. For mounting the conductors, however, in this case an additional step is required.

In other configurations however the spring force is sized so that solid conductors can be used without using a tool. Thus, the spring force is slightly less so that the spring opens through the conductor itself when inserting a fixed wire conductor of this type in that the conductor is inserted in the direction of the side wall and thus impacts the arm of the spring extending at a slant angle thereto so that the spring is loaded through the force transferred through the conductor and an intermediary space is created between the side wall, in particular the contact surface, and the spring end. Softer conductors, e.g. multi wire twisted strand conductors in this configuration however provide too little material resistance so that the pressure imparted upon the spring does not overcome its spring force when the conductors are inserted. For connecting such soft multi strand conductors (which is typically provided using lead end sleeves) the spring is therefore loaded by the tool.

According to another embodiment the connection clamp furthermore includes a clamp housing made from insulating material so that a safe use of the clamp is provided. The clamp housing includes recesses at the respective access locations for connecting the electrical conductors and for access of the tool to the spring.

In some embodiments the clamp housing includes at least two of the previously described power carrying elements including the associated spring and spring receiver. Thus at least four electrical conductors are electrically connectable with a connection clamp in that the at least two power carrying elements are electrically connected. In a particular embodiment the at least two power carrying elements can also be configured in one piece, e.g. at two ends of a continuous metal element.

BRIEF DESCRIPTION OF THE DRAWINGS

Embodiments of the invention will now be described by way of example and with reference to the appended drawing, in which.

DETAIL DESCRIPTION OF EMBODIMENTS

Figure 1:
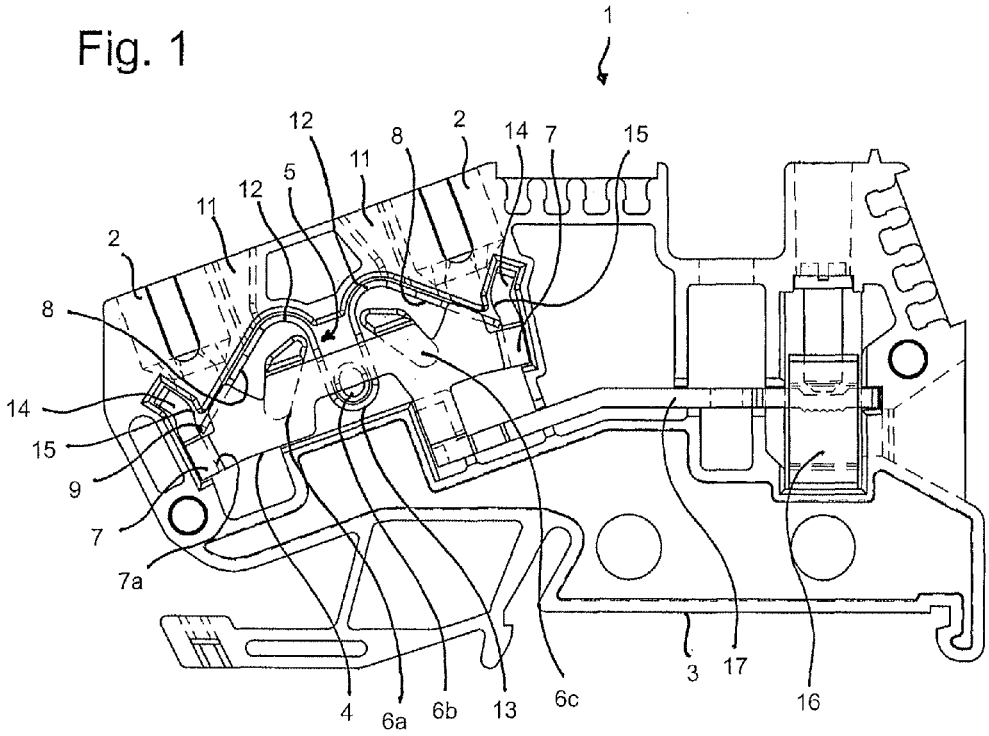
FIG. 1 illustrates a top view of a connection clamp with half open clamp housing.

The connection clamp 1 in FIG. 1 is configured for electrically contacting two electrical conductors (not illustrated in the drawing figure) according to a spring clamp principle. The conductors are insertable in two recesses of a clamp housing 3 of the connection clamp 1 (in FIG. 1) approximately in vertical direction from above. Thus, the connection clamp 1 is configured for clamping and electrically contacting an inserted conductor with a power carrying element 4 and a spring 5. The clamp is also enveloped by a clamp housing 3 made from plastic material, e.g. PVC.

Figure 2:
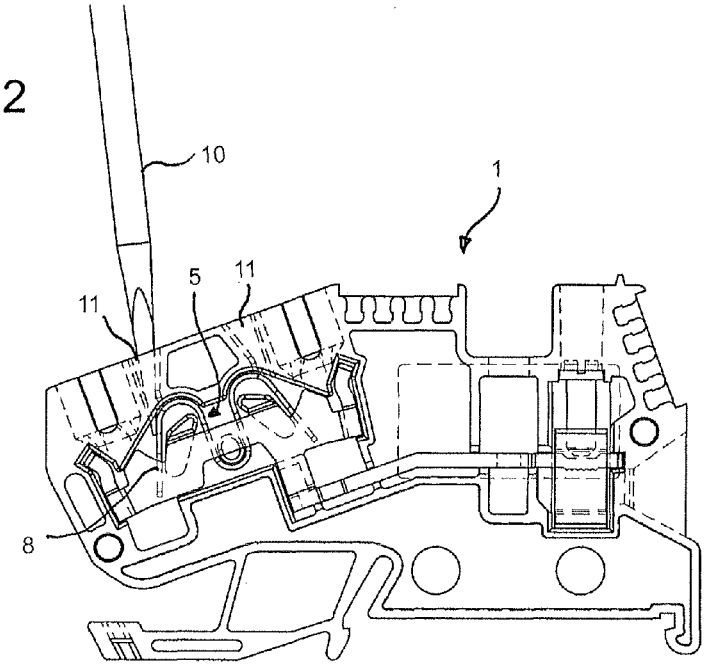
FIG. 2 illustrates the connection clamp according to FIG. 1 with an inserted tool.

The power carrying element 4 is configured for good power carrying capability as a one piece stamped part made from copper sheet material and includes two parallel side walls 7 which are used in particular at their inner opposing sides as a contact surface 7*a* (c.f. FIG. 2) for the electrical conductors so that two inserted conductors extend parallel to one another. Through the overall metallic surface a good electrical connection is provided for any contact of the conductor with the power carrying element 4. Besides the shape of the recesses 2 additional protrusions 14 of the side walls 7 with an inner bulge 15 are used as support when inserting the conductor. The bulge 15 is also used as a contact surface 7*a* for establishing a good electrical contact with a conductor to be inserted. Furthermore the bulge 15 forms a contact surface for the spring 5 so that a movement, thus a movement of the arms 8 in a direction of the recess 2 is limited.

For electrical contacting and mechanical clamping the electrical conductor is clamped with the spring 5 against the side wall 7, in particular the contact surface 7*a*. Thus, arms 8 with a pull safety edge 9 are configured at the spring end on both sides of the spring 5. For an inserted electrical conductor the pull safety edge 9 impresses into the surface of the conductor (not illustrated in the figures) due to the spring force of the spring 5. This way and through the angle □90° between the conductor and the arm 8 the inserted conductor is secured against being pulled out of the connection clamp 1. When no conductor is inserted the spring end 9 contacts the side wall 7 in the direction of the recess 2 in the portion of the protrusion 14 so that a minimum tension of the spring 5 is also provided for thin wires.

For inserting the conductor the spring 5 has to be preloaded due to its high spring force with a rod shaped tool 10, e.g. a screw driver, wherein further recesses 11 are provided for the tool 10 in the clamp housing 3. Thus, as illustrated in FIG. 2, the arm 8 of the spring 5 can be directly deflected with the tool 10 in order to release an intermediary cavity between the spring end 9 and the side wall 7 from the direction of the wire to be inserted, thus approximately in vertical direction. Furthermore the handling of the connection clamp 1 is simplified in that the tool 10 is substantially insertable parallel to an electrical conductor.

Accordingly the tool 10 is required for disengaging an inserted and clamped conductor without destroying it in that the spring end 9 is lifted off from the conductor with the pull safety edge 9 in order to release the conductor.

The spring 5 is configured W-shaped and symmetrical along its longitudinal edge, wherein the arms 8 are respectively connected with a loop 13 through a shoulder 12. Thus the spring 5 is retained and supported by a spring receiver which includes essentially three supports 6*a*, 6*b*, 6*c* which are configured as protrusions of a housing wall of the clamp housing 3 and a portion of the housing wall itself. Also the spring 5 is partially covered by the power conducting element 4 and thus supported by the power conducting element. Furthermore the spring 5 is arranged symmetrical to the power conducting element 4.

Thus, the illustrated embodiment is particularly suitable for connecting conductors with identical cross sections. Other conceivable embodiments which are configured for contacting conductors with different cross sections include an asymmetrical spring 5 (thus arms 8 with different lengths) and/or an asymmetrical arrangement of the spring 5 with respect to the power carrying element 4.

Furthermore the support 6*b* is configured with respect to its cross section profile in the portions oriented towards the spring 5 essentially according to a minimum desired curvature radius of the spring 5 in order to prevent excessive bending of the spring 5. Furthermore the supports 6*a*, 6*c* in the portion of the shoulders 12 are enveloped by the spring 5 by more than 90° and the support 6*b* in the portion of the loop 13 is enveloped by approximately 180°, wherein the support 6*b* essentially completely fills the inner radius of the loop 13 in order to position the spring with negligible clearance. Overall this spring receiver provides independence with respect to the spring effect of both arms 8 so that optionally one or two conductors can be clamped or disengaged from one another through the single spring 5. Thus, the spring 5 is arranged not adjustable with respect to its spring force so that the connection clamp 1 is configured particularly simple, in particular without additional adjustment elements. However, it is also conceivable to use springs 5 with different spring constants.

Furthermore, the connection clamp 1 includes a screw clamp 16 which is electrically connected with the power carrying element 4 through an electrically conductive connection bar 17. Another conductor can be electrically connected through the screw clamp 16.

Figure 3:
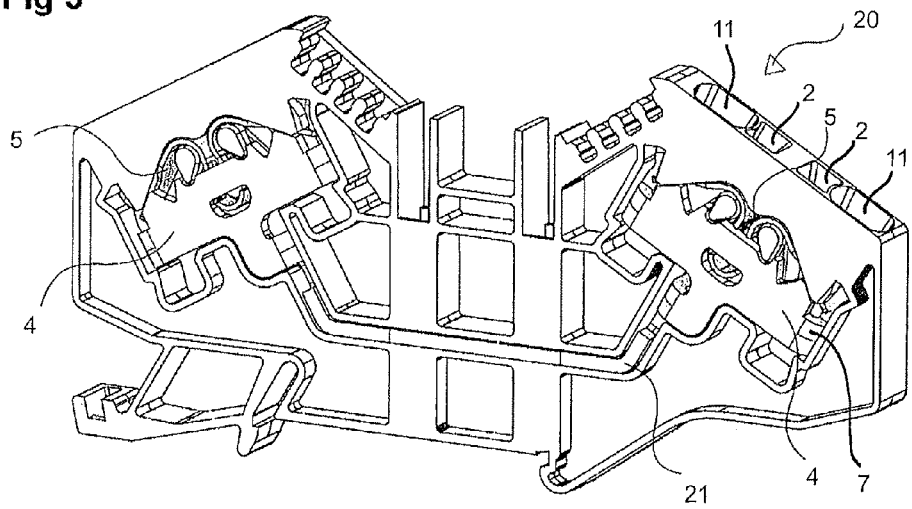
FIG. 3 illustrates a perspective view of a connection clamp for contacting four electric conductors.

Another connection clamp 20 according to FIG. 3 is provided for the electrical connection of four conductors. Thus, the connection clamp differs from the connection clamp 1 according to FIG. 1 in that it includes two of the previously described power carrying elements 4 with respective springs 5 and respective recesses 2, 11 for inserting the conductors and the tool. Thus, the two power carrying elements 4 are electrically connected through a copper connection bar 21, so that all contacted electrical conductors are electrically connectable with one another. Thus, the connection bar 21 can be integrally produced together with the two power carrying elements 4. Alternatively the connection bar 21 and the power carrying elements 5 can also be welded together.

Figure 4:
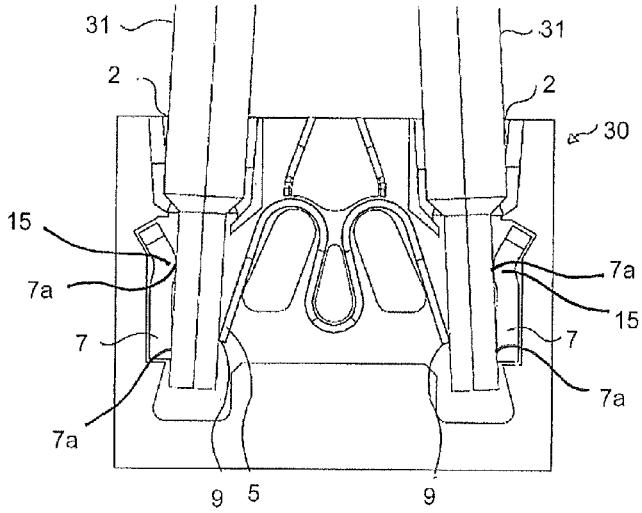
FIG. 4 illustrates a top view of another connection clamp with a half open clamp housing with an inserted conductor.

Another alternative connection clamp 30 according to FIG. 4 differs from the connection clamp illustrated in FIG. 1 in that the spring constant of the spring 5 is smaller, namely small enough so that the spring force can be applied through the electrical conductor 31 and consequently no tool 10 is required for inserting the conductor. Accordingly only the recesses 2 for the conductor 31 are provided in the connection clamp 30. Also for removing the conductor 31 without destroying it from the connection clamp 30 no auxiliary tool 10 is required since due to the reduced spring force no substantial damage of the conductor 31 occurs through the pull safety edge 9. For clarity purposes FIG. 4 only illustrates the side walls 7 of the power carrying element 4. Furthermore FIG. 4 illustrates that the bulge 15 when contacting the electric conductor 31 respectively defines at least two contact surfaces 7*a* per conductor 31, namely on the bulge 15 and on one edge of the side wall 7, so that a reliable electrical connection is provided.

Figure 5:
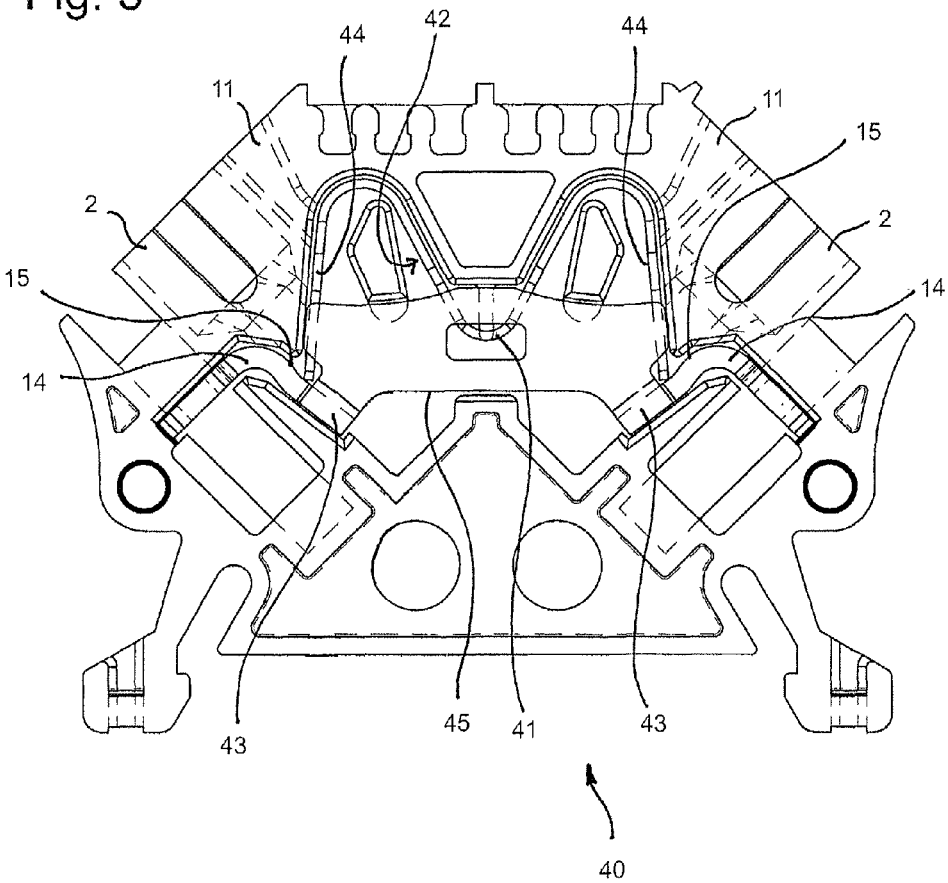
FIG. 5 illustrates a top view of another connection clamp with half open clamp housing.

Another connection clamp 40 according to FIG. 5 differs from the connection clamp 1 previously illustrated in FIGS. 1 and 2 essentially in that it is configured for inserting electrical conductors 31 at a angle of 45° respectively relative to a symmetry axis that is vertical in FIG. 3, wherein the conductors are insertable approximately at 90° relative to one another. This is facilitated in that the loop 41 of the spring 42 includes approximately an opening angle of 56° so that both arms 44 in a condition without an inserted conductor enclose a small angle of approximately 0°-10°. Accordingly the side walls 43 of the current carrying element 45 are not arranged parallel to one another but oriented towards one another approximately at an angle of 80° to 100°.

Although certain products constructed in accordance with the teachings of the invention have been described herein, the scope of coverage of this patent is not limited thereto. On the contrary this patent covers all embodiments of the teachings of the invention fairly falling within the scope of the appended claims either literally or under the doctrine of equivalence.

What is claimed is:

1. A connection clamp for electrically connecting at least two electrical conductors, comprising:

at least one power carrying element with at least two side walls, each side wall including at least one electrical contact surface at the side wall's insides, wherein the at least two side walls are oriented towards one another;

at least one substantially W-shaped spring with a central loop, two shoulders and two outer arms, wherein the outer arms are connected with each other through the shoulders and the central loop; and at least one spring receiver with at least three supports, wherein a first of the at least three supports engages the central loop, a second of the at least three supports engages one of the shoulders, and a third of the at least three supports engages the other shoulder, wherein the second and third supports are enveloped by the shoulders of the spring by more than 90° , wherein the spring is arranged between the side walls, wherein the arms of the spring are respectively arranged at a slant angle relative to the respectively adjacent side wall, wherein each of the outer arms has a spring end, and the spring ends are configured as pull safety edges, and wherein one of the electrical conductors is insertable between one of the spring ends and one of the at least two side walls, and the other of the electrical conductors is insertable between the other of the spring ends and the other of the side walls, wherein the conductors are pressed against the contact surface through spring force of the spring.

2. The connection clamp according to claim 1, wherein the support of the spring receiver arranged in the loop extends over an inner diameter of the loop.

3. The connection clamp according to claim 1, wherein the supports of the spring receiver are arranged in an apex portion of the shoulder or the loop.

4. The connection clamp according to claim 1, wherein the second and third supports have a cross sectional profile with a radius, and the shoulders of the spring enveloping the second and third supports have a minimum radius and the radius of the cross sectional profile of the second and third supports substantially correspond to the minimum radius of the shoulders of the spring.

5. The connection clamp according to claim 1, wherein the spring includes a curvature radius of at least a tenth of the length of the arms in an apex portion of the shoulders and of the loop.

6. The connection clamp according to claim 1, wherein the spring is arranged not adjustable with respect to a spring force of the spring.

7. The connection clamp according to claim 1, wherein the spring is configured symmetrical in longitudinal direction and arranged symmetrical to the contact surfaces of the power carrying element.

8. The connection clamp according to claim 7, wherein the side walls of the power carrying element are arranged substantially parallel to one another.

9. The connection clamp according to claim 1, wherein the spring is loadable through a tool for inserting and disengaging electrical conductors.

10. The connection clamp according to claim 9, wherein one respective arm is directly loadable through the tool.

11. The connection clamp according to claim 9, wherein the force of the spring is strong enough so that loading the spring for at least one of inserting and disengaging electrical conductors is only possible through the tool.

12. The connection clamp according to claim 1, further comprising a clamp housing made from electrically insulating material.

13. The connection clamp according to claim 12, wherein the clamp housing includes recesses for inserting electrical conductors and a tool for inserting and disengaging electrical conductors.

14. The connection clamp according to claim 13, wherein the spring is loadable through the tool for inserting and disengaging electrical conductors, wherein the tool for loading the spring is insertable into the clamp housing substantially parallel to the conductor to be inserted.

15. The connection clamp according to claim 12, wherein the clamp housing includes at least two power carrying elements and associated springs and spring receivers, wherein the power carrying elements are connected in an electrically conducting manner.

* * * * *